US007082079B2

(12) United States Patent
Woo

(10) Patent No.: US 7,082,079 B2
(45) **Date of Patent: *Jul. 25, 2006**

(54) PRESSURE COMPENSATED HYDROPHONE

(75) Inventor: Daniel Ming Kwong Woo, Missouri City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/109,387

(22) Filed: Apr. 19, 2005

(65) Prior Publication Data

US 2005/0195687 A1 Sep. 8, 2005

Related U.S. Application Data

(63) Continuation of application No. 10/393,170, filed on Mar. 20, 2003, now Pat. No. 6,882,595.

(51) Int. Cl.
*H04R 1/00* (2006.01)

(52) U.S. Cl. ..... 367/149

(58) Field of Classification Search ..... 367/167, 367/140, 149, 171, 172; 250/227.16, 227.14; 385/12, 13

See application file for complete search history.

(56) References Cited

U.S. PATENT DOCUMENTS

| | | | |
|---|---|---|---|
| 5,317,544 A | 5/1994 | Mass et al. | |
| 5,363,342 A | 11/1994 | Layton et al. | |
| 5,394,377 A | 2/1995 | VonBieren | |
| 5,625,724 A | 4/1997 | Frederick et al. | |
| 5,668,779 A | 9/1997 | Dandridge et al. | |
| 6,049,511 A | 4/2000 | Erath | |
| 6,122,225 A | 9/2000 | Cheng et al. | |
| 6,233,374 B1 | 5/2001 | Ogle et al. | |
| 6,549,488 B1 | 4/2003 | Maas et al. | |
| 6,882,595 B1 * | 4/2005 | Woo | 367/149 |

FOREIGN PATENT DOCUMENTS

| | | |
|---|---|---|
| GB | 2 305 445 | 4/1997 |
| GB | 2 386 183 | 9/2003 |
| WO | WO 04/034096 | 4/2004 |

OTHER PUBLICATIONS

U.K. Search Report, Application No. GB 0406396.2, dated Jul. 23, 2004.

* cited by examiner

*Primary Examiner*—Daniel Pihulic
(74) *Attorney, Agent, or Firm*—Patterson & Sheridan, L.L.P.

(57) ABSTRACT

A pressure compensated hydrophone for measuring dynamic pressures is disclosed. The hydrophone includes a compliant hollow mandrel with a single optical fiber coiled around at least a portion of the mandrel. The mandrel further includes at least one pressure relief valve for compensating for changes in hydrostatic pressure. The pressure relief valve includes a micro-hole, which allows hydrostatic pressures or low frequency pressure events to couple into the interior of the mandrel to provide compensation against such pressure. Higher frequencies pressure events of interest do not couple through the micro-hole and therefore only act only on the exterior of the mandrel, allowing for their detection. Because (quasi) hydrostatic events are compensated for, the mandrel may be made particularly compliant, rendering the singular fiber optic coil particularly sensitive to the detection of the higher frequency signals of interest.

20 Claims, 6 Drawing Sheets

PRESSURE COMPENSATED HYDROPHONE

CROSS-REFERENCE TO RELATED APPLICATIONS

This application is a continuation of U.S. patent application Ser. No. 10/393,170, filed Mar. 20, 2003, now U.S. Pat. No. 6,882,595. Each of the aforementioned related patent applications is herein incorporated by reference in its entirety.

BACKGROUND OF THE INVENTION

Field of the Invention

This invention relates generally to hydrophones, and more particularly to a pressure compensated fiber optic hydrophone.

Fiber optic hydrophones are well known in the art for measuring seismic and acoustic disturbances. Generally hydrophones are towed behind a ship to measure these disturbances. However, with the increasing development of subsea or land-based oil/well systems, a hydrophone that could be deployed down a well at extreme depths and that could withstand the extremely corrosive downhole environment would provide significant benefits. Such a hydrophone would improve the ability to explore the land surrounding a well site by seismology or to detect other acoustics downhole that could inform the well operator about various aspect of the well's production.

While hydrostatic pressure has a measurable effect on a hydrophone, especially when the hydrophone is deployed at extreme depths, small dynamic pressures, such as propagating acoustic sound waves, have a relatively small effect and therefore are more difficult to measure. When a measurement is to be made at depths where the hydrostatic pressure is great (e.g., thousands of feet down the well), the hydrostatic pressure can overwhelm the acoustic waves by many orders of magnitude.

In an attempt to resolve relatively small dynamic pressures, fiber optic hydrophones generally have two fiber optic "arms"—a sensing arm and a reference arm. Both the sensing arm and the reference arm generally constitute optical fibers coiled around corresponding cylindrical mandrels—an outer compliant mandrel for the sensing arm and an inner rigid mandrel for the reference arm. The compliant mandrel is typically thin walled so that its radius changes easily in response to the acoustic pressures being measured. A cavity is formed between the two mandrels. A gas (e.g., air) or liquid typically fills this cavity. The rigid mandrel may be relatively thick walled, or alternatively thin walled and exposed to the ambient pressure so that its radius would not change. One such hydrophone is disclosed in U.S. Pat. No. 5,394,377 entitled, "Polarization Insensitive Hydrophone," and is incorporated herein by reference in its entirety. While compliant mandrels are very sensitive, they are subject to damage and collapse when subjected to extremely high hydrostatic pressures, particularly if they are gas-backed. The production of such gas-backed designs is also costly, largely due to the need to seal the air cavity existing between the sensing and reference mandrels. Furthermore, the reference fiber must enter and exit this air cavity without disrupting the seal. Leaking and fiber breakage at this seal commonly can occur during the assembly process.

An alternative design that attempts to alleviate the problems with gas-backed designs comprises a solid core wrapped with a reference coil of optical fiber. A compliant material is formed around the reference coil such that a cavity is eliminated. Then a sensing coil of optical fiber is wound around the compliant material. Such a design is disclosed in U.S. Pat. No. 5,625,724 entitled, "Fiber Optic Hydrophone Having Rigid Mandrel," which is incorporated herein by reference in its entirety. While this solid design withstands high pressures when deployed at extreme depths, the design lacks in sensitivity to detect acoustic pressure waves and requires two windings of optical fibers. Other fiber optic hydrophone designs can be found in U.S. Pat. Nos. 5,625,724; 5,317,544; 5,668,779; 5,363,342; 5,394,377, which are also incorporated herein by reference.

The art would benefit from a hydrophone sensitive enough to measure relatively small dynamic pressures while being able to withstand deployment in environments having large hydrostatic pressures. It would be further beneficial for such a hydrophone to contain a single measurement coil, without the need for a reference coil.

SUMMARY OF THE INVENTION

A pressure compensated hydrophone for measuring dynamic pressures is disclosed. The hydrophone includes a compliant hollow mandrel with a single optical fiber coiled around at least a portion of the mandrel. The mandrel further includes at least one pressure relief valve for compensating for changes in hydrostatic pressure. The pressure relief valve includes a micro-hole that allows hydrostatic pressures or low frequency pressure events to couple into the interior of the mandrel to provide compensation against such pressure. Higher frequency pressure events of interest do not couple through the micro-hole and therefore act only on the exterior of the mandrel, allowing for their detection. Because (quasi) hydrostatic events are compensated for, the mandrel may be made particularly compliant, rendering the singular fiber optic coil particularly sensitive to the detection of the higher frequency signals of interest.

BRIEF DESCRIPTION OF THE DRAWINGS

The foregoing and other features and aspects of the present disclosure will be best understood with reference to the following detailed description of embodiments of the invention, when read in conjunction with the accompanying drawings, wherein.

DETAILED DESCRIPTION

In the interest of clarity, not all features of actual implementations of a pressure compensated hydrophone are described in the disclosure that follows. It will of course be appreciated that in the development of any such actual implementation, as in any such project, numerous engineering and design decisions must be made to achieve the developers' specific goals, e.g., compliance with mechanical and business related constraints, which will vary from one implementation to another. While attention must necessarily be paid to proper engineering and design practices for the environment in question, it should be appreciated that the development of a pressure compensated hydrophone would nevertheless be a routine undertaking for those of skill in the art given the details provided by this disclosure.

Figure 1:
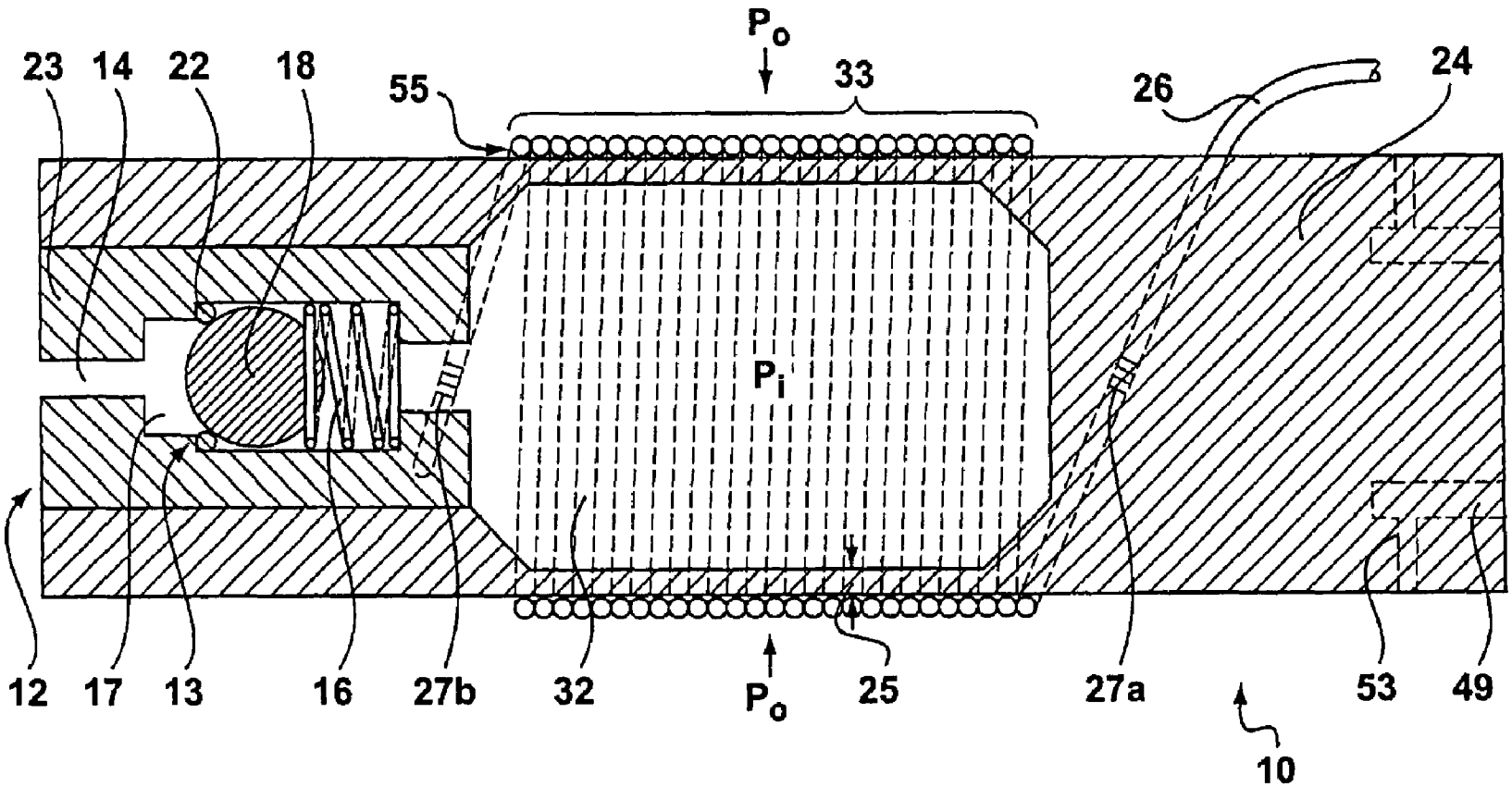
FIG. 1 illustrates a cross sectional view of one embodiment of a pressure compensated hydrophone incorporating a single pressure relief valve.

FIG. 1 depicts an embodiment of a pressure compensated hydrophone 10. The hydrophone 10 includes a preferably flattened oblique mandrel 24 (shown best in FIG. 4) that contains a pressure-relief valve 12 and an inner cavity 32. The inner cavity 32 spans a portion of the length of the mandrel 24 and is preferably filled with a high-viscosity low bulk modulus fluid, such as silicone oil, such that substantially no air is present within the inner cavity 32. The inner cavity 32 acts in tandem with the pressure relief valve 12 to provide pressure compensation for the hydrophone 10, as described in more detail below. The inner cavity 32 is bounded by a wall 25 to define a sensing region 33 of the hydrophone 10. The hydrophone can range from 0.4 to 12 inches in length and from 0.4 to 1.5 inches in diameter, depending on the application at hand.

The mandrel 24 is preferably made of a homogenous material, which will impart a compliance to wall 25 suitable for the particular application at hand. Metal alloys providing suitable compliancy and chemical robustness for oil/gas well applications include non-ferrous alloy materials, alloy steel, or stainless steel. The compliance may vary depending on factors such as the thickness of the mandrel wall 25, and the physical properties of the mandrel material, e.g. its modulus of elasticity. These factors and others may be chosen to help produce favorable sensor sensitivity for detecting the frequencies and magnitudes of interest, as one skilled in the art will realize. For an oil/gas well application, it is preferred that the wall 25 be from 0.005 to 0.1 inches thick, and that the sensing region 33 be from 0.1 to 10 inches long. Different materials or pieces could be used for the mandrel 24 and the wall 25, although it is preferred that they be integral. The mandrel 24 may be formed by standard metal working processes, pressing methods, or an extrusion or drawing process.

A standard optical fiber 26 is coiled around the outside of the mandrel 24 under a predetermined amount of tension and along at least a portion of the sensing region 33. This coil 55 is preferably secured in place around the sensing region 33 by covering it with, an epoxy, adhesive, encapsulating or potting compound, or any other securing means (not shown) capable of withstanding environment (e.g., temperature) into which the mandrel will be deployed. When the hydrophone 10 is subjected to a pressure, e.g., Po, that pressure will exert a force perpendicular to the sensing region as shown. Thus, in the sensing region 33, the pressure will compress the mandrel 24 inward causing the wall 25 of the mandrel 24 to deform. When the mandrel 24 deforms, the coil 55 of optical fiber 26 will correspondingly change in length. Optical detection of this change in length thus allows a determination of the pressure, Po, as will be described in more detail below.

The sensitivity of a fiber optic hydrophone using interferometry principles is a function of the change of strain of the fiber optic coil 55. As noted previously, the coil 55 is preferably pre-strained, or tension wound, such that when the wall 25 of the mandrel 24 deforms inward, the coil 55 will still maintain intimate contact with the wall 25. Maintaining such contact thus helps to maximize the sensitivity of the coil and increases the magnitude of pressures that may be detected. The other objective of pretension is to keep the sensing fiber always in tension and not operating in the compressional mode. Coil sensitivity is further affected by the number of turns in the coil 55. As the mandrel deforms, each turn of the coil 55 will change in length by a slight amount, but this amount is amplified, and therefore easier to optically resolve, when more turns are used. In short, increasing the number of turns will generally increase the sensitivity of the coil 55. While an appropriate length will necessarily depend on the application in question, coil lengths of 5 to 300 feet are believed preferable for detection of downhole acoustics. The coil 55 can consist of a single layer or multiple stacked layer of optical fiber 26 depending on the application.

The mandrel 24 may further include pre-drilled holes 49, 53 to aid in its attachment to another body as described in more detail below. As shown in FIG. 1 the mandrel 24 is formed around a discretely formed pressure relief valve 12, although the mandrel and the housing of the valve may be formed as one integrated unit.

Preferably, the fiber 26 further includes fiber Bragg gratings (FBGs) 27*a*, 27*b* adjacent to both ends of the coil 55. Light reflected from the FBGs 27*a*, 27*b* provides information about the length of the optical fiber, and hence the pressure of the detected acoustics, between the two FBGs. If the FBGs have the same reflection wavelength, the reflected signals will form an interference pattern that can be resolved using fringe counting techniques or other demodulation techniques. One method for interrogating a coil using an interferometric approach is disclosed in U.S. patent application Ser. No. 09/726,059, entitled "Method and Apparatus for Interrogating Fiber optic Sensors," filed Nov. 29, 2000, now U.S. Pat. No. 6,785,004, which is incorporated herein by reference in its entirety.

It should be noted that the use of FBGs bounding the coil 55 is not strictly necessary. If the hydrophone 10 does not contain FBGs, other known interferometric techniques may be used to determine the change in length (circumferential or axial) of the coil 55, such as by Mach Zehnder or Michelson interferometric techniques, which are disclosed in U.S. Pat. No. 5,218,197, entitled "Method and Apparatus for the Non-invasive Measurement of Pressure Inside Pipes Using a Fiber Optic Interferometer Sensor," issued to Carroll, and which is incorporated herein by reference in its entirety. The coils may be multiplexed in a manner similar to that described in Dandridge et al., "Fiber Optic Sensors for Navy Applications," IEEE, February 1991, or Dandridge et al., "Multiplexed Interferometric Fiber Sensor Arrays," SPIE, Vol. 1586, 1991, pp. 176–183, which are also incorporated herein by reference in their entireties.

Alternatively, the FBGs may have different reflection wavelengths in a Wavelength Division Multiplexing (WDM) approach. Moreover, the FBGs themselves, instead of the coil 55 between them, can be coiled around the sensor and used as the sensor(s) for the hydrophone. In such an embodiment, the deformation of the wall 25 would manifest as shifts in the reflection wavelengths of the FBGs, which could be correlated to the pressures being detected, as is well known and not further discussed. In the preferred embodiment of FIG. 1, the FBGs 27*a*, 27*b* are located so as to experience little to no strain, as strain on the FBGs will shift the wavelength of light reflected therefrom which might disturb the pressure measurement. Thus, the optical fiber preferably lies along the mandrel 24 at least slightly outside of the sensing region 33 and compliant wall 25. Alternatively, the FBGs 27*a*, 27*b* may be isolated from the wall 25 by isolation pads or similar devices, as is disclosed in U.S. patent application Ser. No. 09/726,060, entitled "Apparatus For Protecting Sensing Devices," filed Nov. 29, 2000, now U.S. Pat. No. 6,501,067, which is incorporated herein by reference in its entirety.

As alluded to earlier, the disclosed hydrophone further includes a pressure relief valve 12 to compensate for changes in hydrostatic pressure, which may result as the hydrophone is deployed deeper and deeper into a well. The pressure relief valve 12 preferably includes a micro-hole 14. This micro-hole 14 acts as a mechanical low pass filter that has a diameter such that pressure waves above a certain frequency, e.g., 3 Hz, are unable to pass through the micro-hole 14. Because these higher frequencies will not exert a pressure on the valve 12, they will not affect the pressure inside the inner cavity 32, which allows the presence of such higher frequency components to be detected by the coil 55. By contrast, frequencies below this cut off will exert pressure both inside and outside of the coil, and will not be detectable. As most frequencies of interest in acoustic phenomenon to be detected are above this range, this frequency limitation does not appreciably limit the operation of the hydrophone. In a preferred embodiment, the diameter of micro-hole 14 ranges from about 0.001 to 0.1 inches.

The micro-hole 14 in conjunction with the valve 12 allows for the compensation of hydrostatic pressures. The valve 12 includes a housing 23 containing a ball 18 normally biased against an elastomeric O-ring 22 by a spring 16. The spring 16 exerts a predetermined force against the ball 18 ("valve closing force"), which is determined by the amount of compression of the spring and its spring constant. Preferably, this force maintains approximately a 50 psi difference between the PI of the inner cavity 32 and the Po of the outer environment. In one embodiment, the valve 12 may comprise a 0.187" Unscreened Pressure Relief Valve manufactured by The Lee Company. This valve is constructed entirely of stainless steel, has a diameter of 3/16 inch, is approximately ½ inch long, and imparts a valve closing force from 20 to 100 psi.

As the components of the valve 12 may become exposed to the fluids present in the well, it is preferred that they be made of suitably resilient materials. Ball 18 may be made of a metal alloy such as stainless steel, ceramic, or plastic or rubber materials such as closed cell synthetic rubber, solid natural rubber, polyurethane, polyethylene, silicone rubber, or neoprene. The ball 18 may be hollow and may take other shapes (e.g., cylindrical) so long as it is movable in response to the increasing external pressure and is capable of forming a good seal. If the ball is made of a deformable material, the O-ring 22 may be eliminated from the pressure relief valve 12. The spring 16 preferably comprises a metal alloy such as stainless steel. Biasing means other than springs may also be used so long as they are sufficient to maintain the required internal pressure Pi within the inner cavity.

It is preferred to form the valve 12 within its housing 23 before coupling the housing 23 to the mandrel 24, although these components can be formed as an integral piece. Coupling between the housing 23 and the mandrel 24 may be effectuated by a screw relationship, by welding, or by other well known means (not shown). Thereafter, the inner cavity 32 of the hydrophone can be filled with oil by using a thin probe to depress the ball and introducing oil through the micro-hole 14. Alternatively, the inner cavity 32 can be filled with oil prior to the coupling of the housing 23 to the mandrel 24.

As noted earlier, some prior art hydrophones were limited with respect to the pressures to which they could be exposed, as high pressures presented the risk of collapsing the relatively thin wall around which the sensing coils were wrapped. This problem has been alleviated in the disclosed hydrophone design because the pressure inside of the hydrophone can roughly be brought into equilibrium with the external hydrostatic pressure. When the external pressure Po exceeds the valve closing force of valve 12 (e.g., 50 psi), the ball 18 of the valve 12 will start to open, which allows the external pressure to couple into the inner cavity through micro-hole 14. (Depending on the viscosity of the oil in the inner cavity 32 and the diameter of the ball 18 within its housing 23, the well fluid and the oil within the hydrophone may mix, but this is not deleterious to the operation of the hydrophone. Should particulates in the well fluid cause concern that the valve might become jammed, a mesh or screen (not shown) may be placed within the micro-hole 14). Accordingly, the hydrophone 10 may be deployed to great depths and subjected to great pressures (e.g., 20,000 psi) while still retaining a relatively thin (and dynamically sensitive) wall 25, which is capable of detecting higher frequency acoustic phenomenon as explained earlier.

Figure 2:
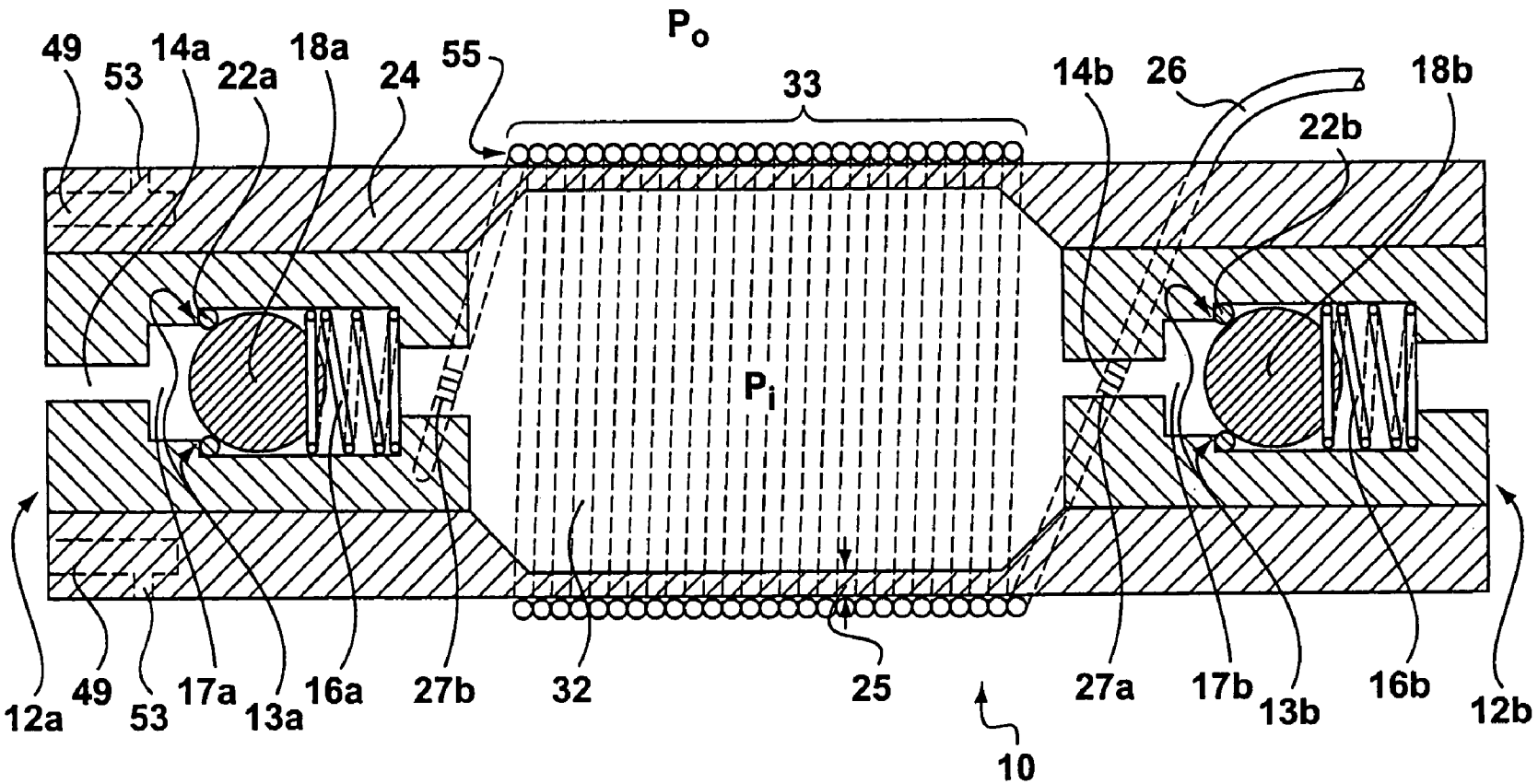
FIG. 2 illustrates across sectional view of one embodiment of a pressure compensated hydrophone incorporating first and second pressure relief valves.

FIG. 2 discloses an embodiment of the hydrophone which provides both descending and ascending pressure compensation, and which incorporates two pressure relief valves 12*a*, 12*b*. Valve 12*a* allows for descending pressure compensation, as described above. Valve 12*b*, which is similar (or identical) in structure to valve 12*a*, allows for ascending pressure compensation, and operates as follows. When the hydrophone 10 is raised from a lower depth to a higher depth, the external hydrostatic pressure decreases. Because the inner cavity had been coupled to a higher pressure at the lower depth, the volume of the fluid within the inner cavity 32 will expand at the higher depth. When the pressure of the inner cavity 32 exceeds the sum of the external pressure and the valve closing force of valve 12*b* (again, preferably 50 psi), valve 12*b* will open and equilibrate the external and internal pressures. When the external pressures fall below the valve closing force (e.g., 50 psi), valve 12*b* will close, thus trapping the fluid within the inner cavity 32 at the valve closing force. One skilled in the art will recognize that valves 12*a* and 12*b* are "one way" valves. Accordingly, when the hydrophone descends, valve 12*b* is prevented from opening due to the pressure the ball 18*b* exerts on the O-ring 22*b*; similarly, when the hydrophone ascends, valve 12*a* is prevented from opening due to the pressure the ball 18*a* exerts on the O-ring 22*a*. In summary, the structural integrity of the hydrophone 10 as shown in FIG. 2 remains intact as the hydrostatic pressure changes.

Depending on the application at hand, an embodiment of the disclosed hydrophone could have either or both of the valves 12*a*, 12*b*. For example, if it is not anticipated that the hydrophone 10 will be retrieved, valve 12*b*, providing for ascending pressure relief, may not be necessary. Moreover, if the hydrophone 10 is not going to be placed sufficiently deeply such that descending pressure compensation will cause a problem, or if the inner cavity can be prepressurized to a suitably high value, then valve 12*a*, providing for descending pressure relief, may not be necessary. Additionally, in an embodiment having both valves 12*a*, 12*b*, the valve closing forces of the two valves need not be the same.

Figure 3:
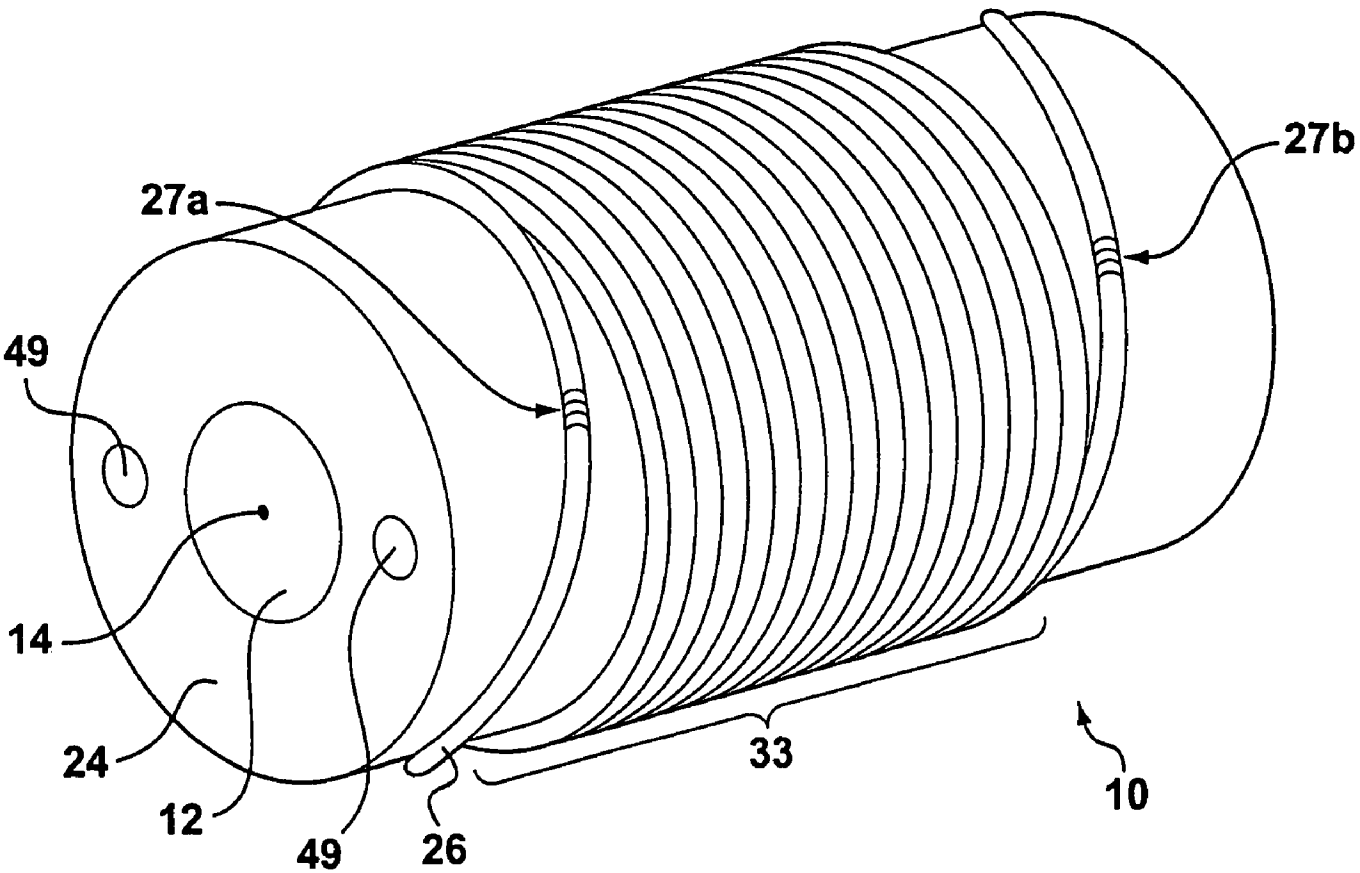
FIG. 3 illustrates a perspective view of an embodiment of a pressure compensated hydrophone.
Figure 4:
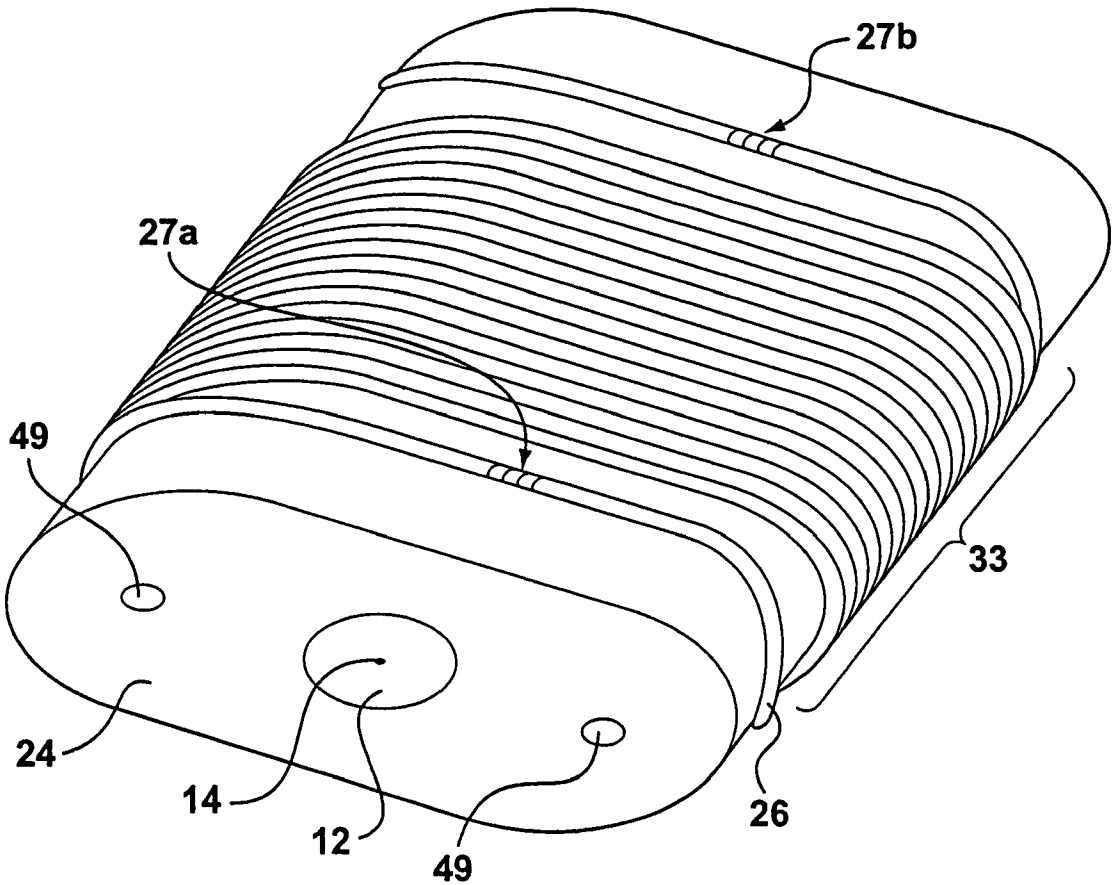
FIG. 4 illustrates a perspective view of another embodiment of a pressure compensated hydrophone.

The disclosed hydrophone 10 may be cylindrical in shape as shown perspectively in FIG. 3, but may also comprise a preferable more flattened shape as shown in FIG. 4. This flattened, oblique cylindrical, shape renders the hydrophone more sensitive to the dynamic acoustic pressures being measured, as the hydrophone is more compliant along the elongated surfaces when compared with a cylindrical embodiment.

Figure 5:
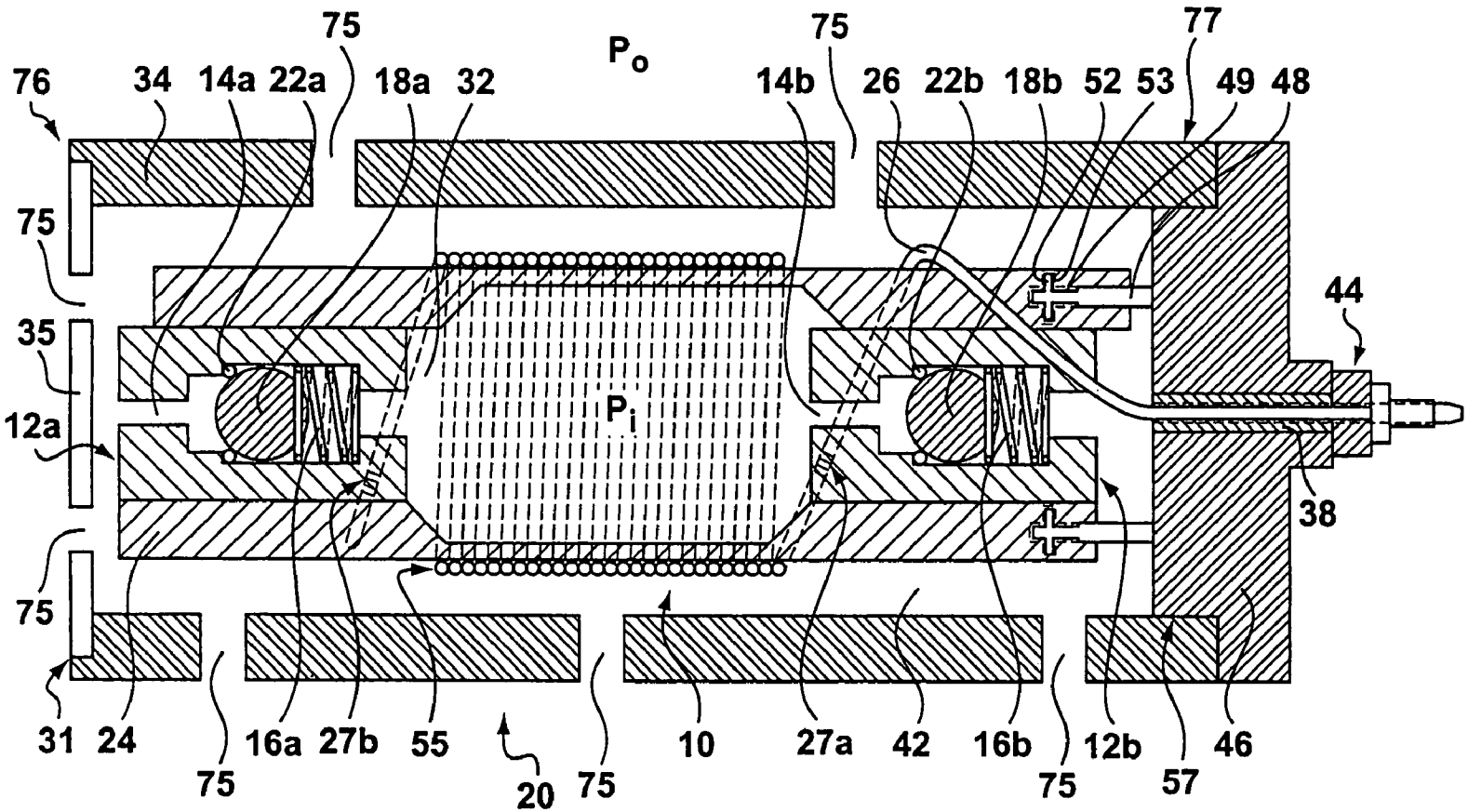
FIG. 5 illustrates a cross sectional view of one embodiment of a pressure compensated hydrophone package assembly.

FIG. 5 discloses the hydrophone 10 within a perforated housing 34 to form a hydrophone package assembly 20. Essentially, housing 34 provides mechanical protection to the hydrophone 10 (and particulauly to the fiber optics), while still allowing dynamic and static pressures to couple to the hydrophone 10 through holes 75. The housing 34 may include a first recessed end 76 and a second open end 77. The first recessed end 76 of the housing 34 is joined to a disc 35. The disc 35 and the housing 34 are composed of a metal suitable for the intended environment of the hydrophone assembly 20, such as stainless steel or Inconel. The disc 35, the housing 34, or both further include pressure relief holes 75 for allowing the well bore fluid to enter into the housing cavity 42. Preferably the fiber 26 is sufficiently encapsulated with a coating material, such as an epoxy, to protect the fiber 26 from the corrosive effects of the well bore fluid. The thickness of the disc 35 or housing 34 may be varied depending on the temperature and harshness of the environment and the expected pressure. The disc 35 is preferably joined to the recessed end 76 of the housing 34 by laser welding, although other techniques or methods known in the art can be used. Furthermore, the disc 35 and the housing 34 may be formed into one integral housing or sleeve as opposed to joining two separate pieces together. The second end 77 of the housing 34 is joined to an end cap 46, which further includes an optical feedthrough 38 such as disclosed in U.S. patent application Ser. No. 09/628,264, entitled "Optical Fiber Bulkhead Feedthrough Assembly And Method For Making Same," filed on Jul. 28, 2000, now U.S. Pat. No. 6,526,212, now U.S. Pat. No. 6,526,212, which is incorporated herein by reference. The fiber optic feedthrough 38 allows the fiber 26 to pass through the end cap 46 on its way to the optical source/detection equipment preferably residing at the surface of the well (not shown). A metal capillary tube 44, or series of interconnecting tubes, preferably protects the fiber 26 as it exits the housing 34. The capillary tube(s) 44 is preferably welded to the end cap 46, and details concerning the welding process and other applicable manufacturing details are disclosed in U.S. patent application Ser. No. 10/266,903, entitled "Multiple Component Sensor Mechanism," filed Oct. 6, 2002, now U.S. Pat. No. 6,888,972, which is incorporated herein by reference. The feedthrough 38 preferably seals the fiber 26 in place with an epoxy, glass, or other sealing material known in the art depending on the intended pressure and temperature to be encountered. The end cap 46 may then be threadably connected to the housing 34 or may be connected by other known mechanical means or by welding. If the end cap 46 is welded to the housing 34, the end cap should have an end cap shoulder 57 that extends a sufficient distance within the inner dimension of the housing 34 to dissipate heat during the welding operation. For example, the shoulder 57 of the end cap 46 may extend approximately 4.5 mm into the housing 34, which has an inner dimension of approximately 19 mm.

The hydrophone 10 is supported within the housing 34 preferably by the use of locating pins 48 attached to the end cap 46, which may be similar to clevis pins. The locating pins 48 fit within pre-drilled holes 49 where a second smaller pin 52, such as or similar to a cotter pin, is inserted into the locating pin 48 to lock the locating pin 48 in place. The hydrophone 10 may further include a second pre-drilled hole 53 for the placement of the smaller pin 52 (see FIG. 2). The hydrophone 10 is thus sufficiently supported within the housing 34 without making contact thereto except at the location of the pin mechanisms. As one will realize, one or more pin/locating pin mechanisms may be employed, and the scope of the present invention is not limited to the embodiments shown. Additionally, the hydrophone 10 may be affixed within the housing 34 in other ways, as one skilled in the art will realize.

Alternatively, the housing cavity 42 may be sealed from the well bore fluid. With a solid housing 34 and a corrugated diaphragm (not shown), instead of a perforated disc 35, the hydrophone 10 (and in particular the fiber optics) would be protected from the corrosive affects of the well bore fluid. In such an embodiment, the housing cavity 42 may be filled with a fluid such as silicone fluid. To alleviate the thermal expansion of the fluid when the hydrophone assembly 20 is exposed to high temperatures, a compensator (not shown) is preferably disposed within the housing 34. The compensator has a variable volume responsive to the thermal expansion of the fluid. The compensator may preferably comprise a hollow bellow composed of metal. In an additional embodiment, the hydrophone 10 may preferably be enclosed within compliant tubing, which provides for static pressure compensation as well as allows the dynamic acoustics to couple into the tubing. Such compliant tubing may be formed from polyurethane or other similar plastic material. Furthermore, the tubing may be fluid-filled or alternatively have a solid core filled with, for example, polyurethane foam or other suitable material.

The hydrophone assembly 20 allows for the coil 55 to sense dynamic acoustic pressure waves. The hydrophone assembly 20 is designed to be deployed in the well annulus between the production pipe 54 (shown in FIG. 6) and the well casing 62 where it will be subjected to high temperatures, pressures, and potentially caustic chemicals or mechanical damage by debris within the annulus. Because these conditions could potentially damage an optical fiber, the pressure relief holes 75 may further include a mesh or filter device for preventing the entry of particles into the housing cavity while allowing the entry of static and dynamic pressures. The dynamic acoustics then exert a pressure onto the hydrophone 10 deforming the coil 55. The dynamic acoustics may then be detected, while the hydrostatic pressures are compensated for within the hydrophone cavity 32 as described previously. It should be noted however that the use of a housing 34 is not strictly necessary, and the hydrophone could work in a given environment without such a housing. If a housing 34 is not used, the fiber optic cable and coil 55 should be coated for protection, for example, with a suitably resilient epoxy as mentioned earlier.

Figure 6:
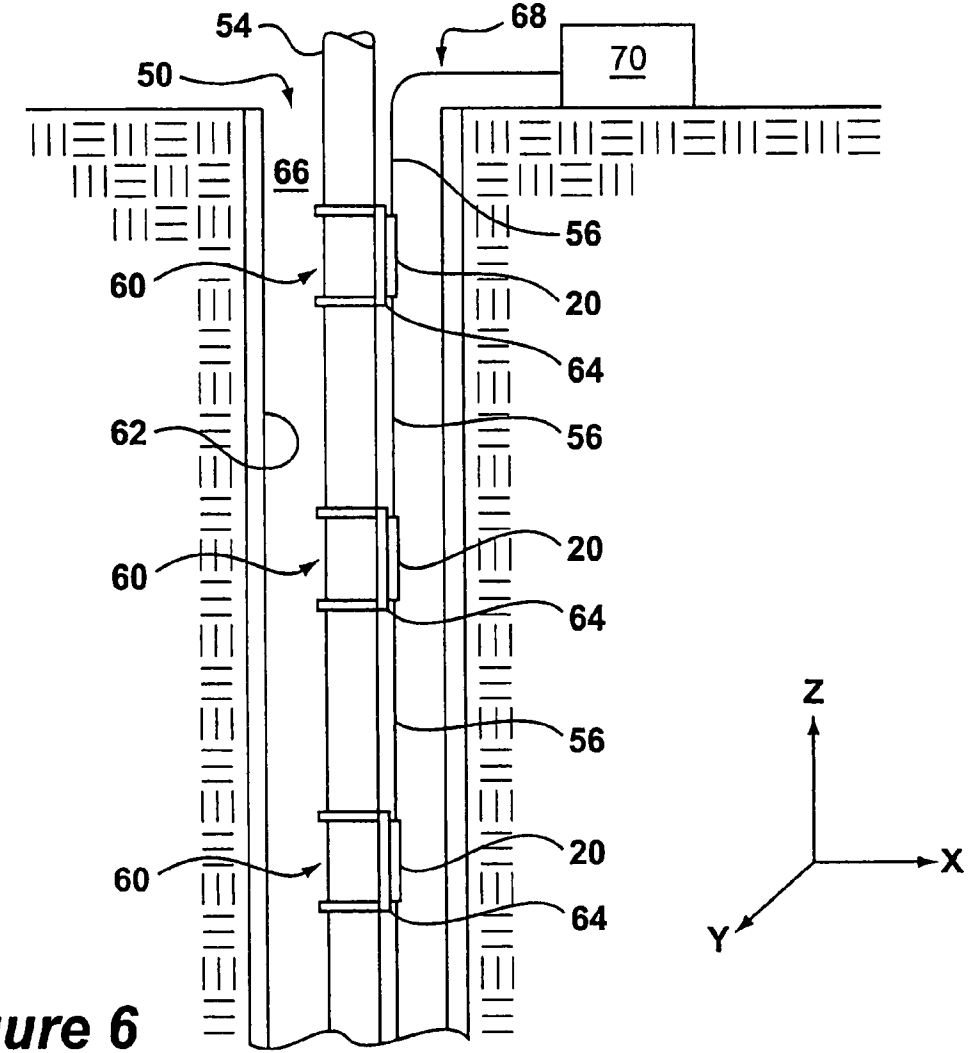
FIG. 6 schematically illustrates an array of hydrophone package assemblies deployed in a well and connected by inter-station cables.

Turning to the schematic illustration in FIG. 6, a fiber optic in-well seismic array 68 used in the exploration of a hydrocarbon reservoir is depicted. The array 68 has a plurality of seismic stations 60 which include the disclosed hydrophone package assemblies 20 interconnected by interstation cables 56. The array 68 is shown deployed in a well 50, which has been drilled down to a subsurface production zone and is equipped for the production of petroleum effluents. Typically, the well 50 includes a casing 62 coupled to the surrounding formations by injected cement. Production tubing 54 is lowered into the cased well 50 with the seismic stations clamped thereto, which may be accomplished using the techniques and apparatuses disclosed in U.S. patent application Ser. No. 10/266,715, entitled "Apparatus and Method for Transporting, Deploying, and Retrieving Arrays Having Nodes Interconnected by Sections of Cable," filed Oct. 6, 2002, which is incorporated by reference in its entirety. The well 50 can be fifteen to twenty thousand feet or more in depth.

The seismic stations 60 include hydrophone assemblies 20 and clamp mechanisms 64 such as disclosed in U.S. Provisional Patent Application Ser. No. 60/416,932, entitled "Clamp Mechanism for In-Well Seismic Sensor," filed Oct. 6, 2002, now U.S. patent application Ser. No. 10/678,963 filed on Oct. 3, 2003, which is incorporated by reference in its entirety. The hydrophone assemblies 20 are interconnected by the inter-station cables 56 to an instrumentation unit 70, which may be located at the surface or on an oil platform (not shown). The instrumentation unit 70 typically includes optical source/detection equipment, such as a demodulator and/or optical signal processing equipment (not shown). The inter-station cables 56 (i.e., cable 44 of FIG. 5) are typically I!4 inch diameter cables housing optical fibers between the hydrophone assemblies 20 and the instrumentation unit 70.

The optical source within the instrumentation unit 70 may include a semiconductor laser diode that may be pulsed to effectuate the preferred interferometric coil interrogation technique discussed earlier. However, and as one skilled in the art understands, there are various other optical signal analysis approaches that may be used to analyze the reflected signals from the hydrophone, such as (1) direct spectroscopy, (2) passive optical filtering, (3) tracking using a tunable filter, or (4) fiber laser tuning (if a portion or all of the fiber between a pair of FBGs is doped with a rare earth dopant). Examples of a tunable laser can be found in U.S. Pat. Nos. 5,317,576; 5,513,913; and 5,564,832, which are incorporated herein by reference. One skilled in the art will also appreciate that the use of a fiber optic sensor in the disclosed hydrophone easily lends itself to multiplexing to other hydrophones or to other fiber optic devices along a single fiber optic transmission cable (i.e., cables 56), such as by the TDM or WDM approaches alluded to earlier.

The disclosed hydrophone assembly 20 has many potential downhole uses, but is believed to be particularly useful in vertical seismic profiling to determine the location of petroleum effluents in the geologic strata surrounding the well in which the hydrophones are deployed. (Further details concerning vertical seismic profiling are disclosed in U.S. patent application Ser. No. 09/612,775, entitled "Method and Apparatus for Seismically Surveying an Earth Formation in Relation to a Borehole," filed Jul. 10, 2000, now U.S. Pat. No. 6,601,671, which is incorporated herein by reference in its entirety). As is known, a seismic generator (not shown) detonated at the surface near the well is used to generate acoustic waves which reflect off of the various strata and are detected by the hydrophone assemblies 20 at each seismic station 56. In this application, the seismic stations 60 are distributed over a known length, for example, 5000 feet. Over the known length, the seismic stations 60 can be evenly spaced at desired intervals, such as every 10 to 50 feet, as is necessary to provide a desired resolution. Accordingly, the fiber optic in-well seismic array 68 can include hundreds of hydrophone assemblies 20 and associated clamp mechanisms 64. Because fiber optic connectors on the inter-station cables 56 between the hydrophone assemblies 20 can generate signal loss and back reflection of the interrogating signals, the use of such connectors is preferably minimized or eliminated in the array. Instead, it is preferred to splice together the various components along a single fiber optic cable, which minimizes signal loss. Such splicing may be performed in accordance with the techniques disclosed in U.S. patent application Ser. No. 10/266,903, which has already been incorporated herein. If optical loss is still too significant along the entirety of the array even when splicing is used, different fiber optic cables can be used to interrogate different sections of the array, which requires inter-station cable 56 to possibly carry multiple fiber optic cables.

As used herein, "hydrostatic pressure" should be understood to include low frequency "quasi static" pressures capable of coupling into the inner cavity of the hydrophone, and hence which are not detectable as explained earlier. Moreover, a "valve" should be understood as meaning a discrete component for selectively blocking or not blocking the transfer of fluid. Accordingly, a "valve" should not be understood as referring to a mere port, conduit, or hole, even if such a port, conduit, or hole acts to restrict the transfer of fluid in certain circumstances.

The invention is not limited to the above-disclosed embodiments, but instead is defined by the following claims and their equivalents.

What is claimed is:

1. A hydrophone assembly for detecting dynamic acoustics, comprising:

a mandrel with an inner cavity;

an optical fiber coiled around an outside surface of the mandrel; and a micro-hole configured to provide fluid communication between an interior of the inner cavity and an exterior surrounding the mandrel, wherein a diameter of the micro-hole is such that pressure waves above three hertz are unable to pass through the micro-hole.

2. The hydrophone assembly of claim 1, wherein the diameter of the micro-hole ranges from about 0.001 to 0.1 inches.

3. The hydrophone assembly of claim 1, wherein the micro-hole forms part of a pressure relief valve.

4. The hydrophone assembly of claim 3, wherein the pressure relief valve is a one way valve.

5. The hydrophone assembly of claim 3, wherein the pressure relief valve is capable of maintaining a predetermined pressure differential between the interior and the exterior.

6. The hydrophone assembly of claim 1, wherein the mandrel comprises an oblique cylinder.

7. The hydrophone assembly of claim 1, further comprising a housing that contains the mandrel.

8. A system for detecting dynamic acoustics in a wellbore, comprising:

at least one hydrophone package assembly, comprising:

a mandrel with an inner cavity;

an optical fiber coiled around an outside surface of the mandrel to provide signals indicative of the dynamic acoustics based on a change in length of the optical fiber; and a pressure relief valve configured to selectively provide fluid communication between an interior of the inner cavity and an exterior surrounding the mandrel;

a tubing that the at least one hydrophone package is secured thereto within the wellbore; and an instrumentation unit connected to the at least one hydrophone package via a cable, wherein the instrumentation unit is configured to process the signals received from the cable.

9. The system of claim 8, further comprising at least one clamp mechanism for securing the at least one hydrophone package to the tubing.

10. The system of claim 8, wherein the instrumentation unit is located at a surface of the wellbore.

11. The system of claim 8, wherein the at least one hydrophone package comprises a plurality of hydrophone packages spaced over a length of the wellbore to provide a seismic array.

12. The system of claim 11, wherein the pressure relief valve includes a micro-hole having a diameter such that pressure waves above three hertz are unable to pass through the micro-hole.

13. The hydrophone assembly of claim 11, wherein the pressure relief valve is capable of maintaining a predetermined pressure differential between the interior and the exterior.

14. A hydrophone assembly for detecting dynamic acoustics, comprising:

a mandrel with an inner cavity;

an optical fiber coiled around an outside surface of the mandrel;

an ascending pressure relief valve configured to selectively relieve pressure within an interior of the inner cavity; and a descending pressure relief valve configured to selectively increase pressure within the interior of the inner cavity.

15. The hydrophone assembly of claim 14, wherein each of the pressure relief valves include a micro-hole having a diameter such that pressure waves above three hertz are unable to pass through the micro-hole.

16. The hydrophone assembly of claim 15, wherein the diameter of the micro-holes ranges from about 0.001 to 0.1 inches.

17. The hydrophone assembly of claim 14, wherein the pressure relief valves are one way valves.

18. The hydrophone assembly of claim 14, wherein the pressure relief valves are capable of maintaining a predetermined pressure differential between the interior and the exterior.

19. The hydrophone assembly of claim 14, wherein the mandrel comprises an oblique cylinder.

20. The hydrophone assembly of claim 14, further comprising a housing that contains the mandrel.

* * * * *